US009687034B2

(12) United States Patent
Clemente

(10) Patent No.: US 9,687,034 B2
(45) Date of Patent: Jun. 27, 2017

(54) HEATED GLOVES

(71) Applicant: Joseph Clemente, New City, NY (US)

(72) Inventor: Joseph Clemente, New City, NY (US)

( * ) Notice: Subject to any disclaimer, the term of this patent is extended or adjusted under 35 U.S.C. 154(b) by 0 days.

(21) Appl. No.: 15/050,693

(22) Filed: Feb. 23, 2016

(65) Prior Publication Data

US 2016/0249695 A1 Sep. 1, 2016

Related U.S. Application Data

(60) Provisional application No. 62/119,355, filed on Feb. 23, 2015.

(51) Int. Cl.
*A41D 19/015* (2006.01)
*A41D 19/00* (2006.01)

(52) U.S. Cl.
CPC ..... *A41D 19/01535* (2013.01); *A41D 19/002* (2013.01); *A41D 19/01594* (2013.01)

(58) Field of Classification Search
CPC ..... A41D 19/01594; A41D 19/01535; A41D 19/0024; A41D 13/0058; A41D 13/0051; A41D 13/0025
USPC ..... 219/211; 2/160
See application file for complete search history.

(56) References Cited

U.S. PATENT DOCUMENTS 3,712,288 A * 1/1973 Weiss ..... A41D 19/01535 126/206
4,281,418 A * 8/1981 Cieslak ..... A43B 7/02 126/206
4,764,665 A 8/1988 Orban et al.
4,777,344 A 10/1988 Nash et al.
4,800,867 A * 1/1989 Owens ..... A43B 7/02 126/204
4,825,049 A 4/1989 Rickborn
4,941,271 A * 7/1990 Lakic ..... A41D 19/01535 36/117.1
5,035,003 A * 7/1991 Rinehart ..... A41D 19/01535 2/159
5,187,814 A * 2/1993 Gold ..... A41B 11/00 2/160
5,866,881 A 2/1999 Jones, III
6,055,670 A * 5/2000 Parker ..... A41D 19/01535 2/16
6,078,025 A 6/2000 Yeung
6,239,410 B1 5/2001 Tackore
6,268,595 B1 * 7/2001 Haenel ..... A61F 7/02 219/211
6,713,733 B2 3/2004 Kochman et al.
7,002,104 B2 2/2006 Gilligan et al.
7,103,919 B2 * 9/2006 Isom ..... A41D 19/0079 2/160
7,251,837 B1 * 8/2007 Horton ..... A41D 19/01535 2/160
2008/0156893 A1 * 7/2008 Shim ..... A43B 7/02 237/81
2008/0201818 A1 8/2008 Nilforushan et al.

FOREIGN PATENT DOCUMENTS

FR 2124257 A1 * 9/1972 ..... A41D 19/01535

* cited by examiner

*Primary Examiner* — Ruth Ilan
(74) *Attorney, Agent, or Firm* — John R. Benefiel

(57) ABSTRACT

A heated glove in which air warmed by a heat pack insert is circulated to the glove finger and thumb pockets by a pumping arrangement to warm a wearer's fingers and thumb.

2 Claims, 5 Drawing Sheets

HEATED GLOVES

CROSS REFERENCE TO RELATED APPLICATIONS

This application claims the benefit of U.S. provisional patent application No. 62/119,355 filed on Feb. 23, 2015.

BACKGROUND OF THE INVENTION

This invention concerns body coverings and in particular hand coverings and in particular gloves, of a type worn to keep the hands including the fingers and thumb warm in cold weather.

Baseball players in particular need to keep their fingers and thumbs warm when batting and often wear unheated gloves when at bat, which also improves the grip.

Keeping the hands warm has long been a problem since they are largely separated from the main body mass which generates body heat.

The fingers and thumb in particular are vulnerable to cold since they are relatively thin despite wearing gloves.

Mittens are warmer since the fingers are next to each other but prevent the separate use of the fingers for carrying out some manipulation.

Keeping the hands warm using heating packs inserted in a pocket sewn into the gloves have thus long been in use.

Heating packs typically contain materials react to give off heat after being exposed to the air to be energized, which heat production typically continues for several hours.

This has alleviated the problem for skiers and others engaged in cold weather sports or other activities.

However, the fingers and thumb are remote from the heating packs and generally may still become cold.

Electrical heating elements powered by batteries have been developed for body coverings such as gloves and jackets which have enabled distribution of heat to every area of the body, but batteries are bulky and expensive and may not last for extended periods. Thus the problem of keeping the fingers and thumb or the hand warm has not been completely solved by this approach.

It is an object of the present invention to provide heated hand gloves which does not require batteries but distributes heat to the fingers and thumb of a wearer to keep them warm.

SUMMARY OF THE INVENTION

The above object is achieved by gloves having a pocket for receiving a conventional heating pack which when activated generates heat in the well known manner.

An air distribution system is built in to the glove which causes air heated by the heat pack to be directed out to the fingers and thumb enclosing portions of the glove to effectively warm those parts of the hand of the wearer.

The air distribution system can either be one way to pass out of the glove after flowing over the fingers and thumb or recirculating in which air is returned to an area next to the heating pack after being circulated over the finger and thumb to be reheated and again circulated out to the thumb and fingers of the wearer.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
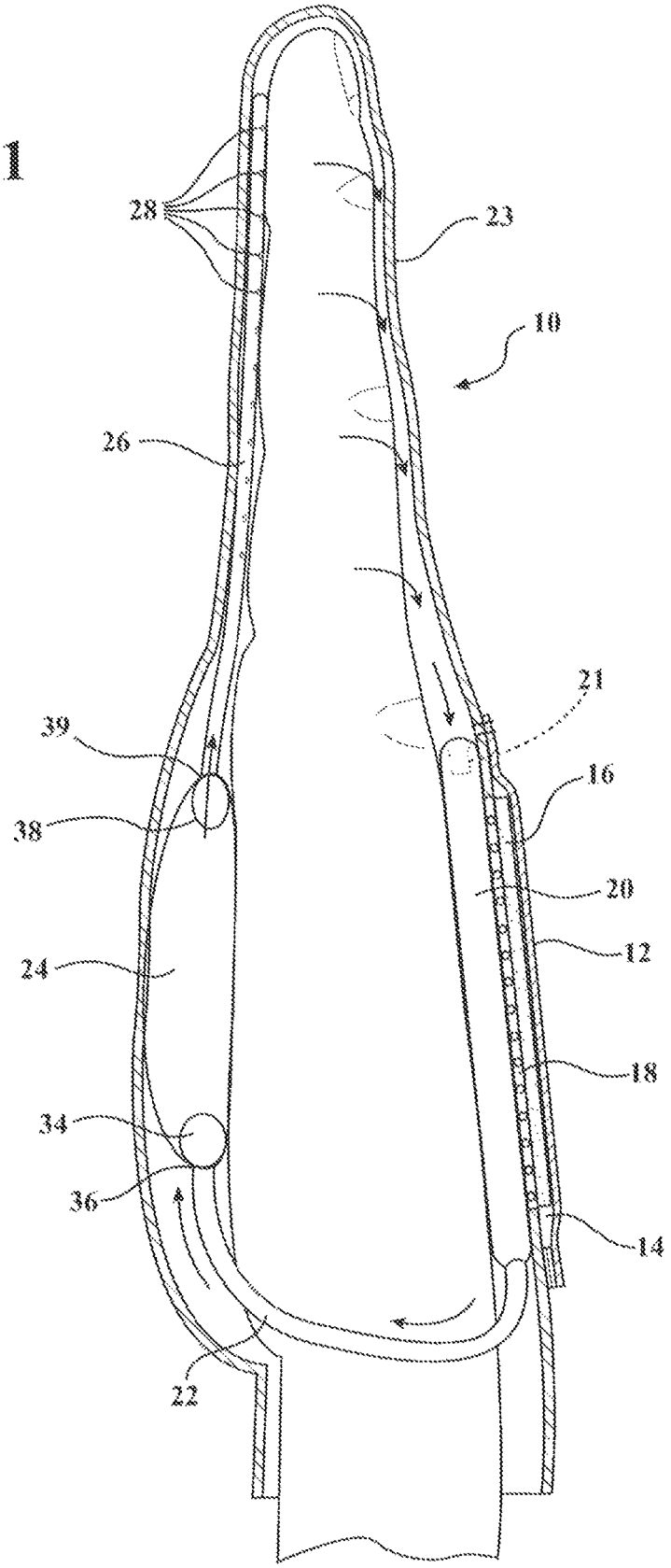
FIG. 1 is a partially sectional view of a heated glove according to the invention with the hand of a wearer inserted therein.
Figure 2:
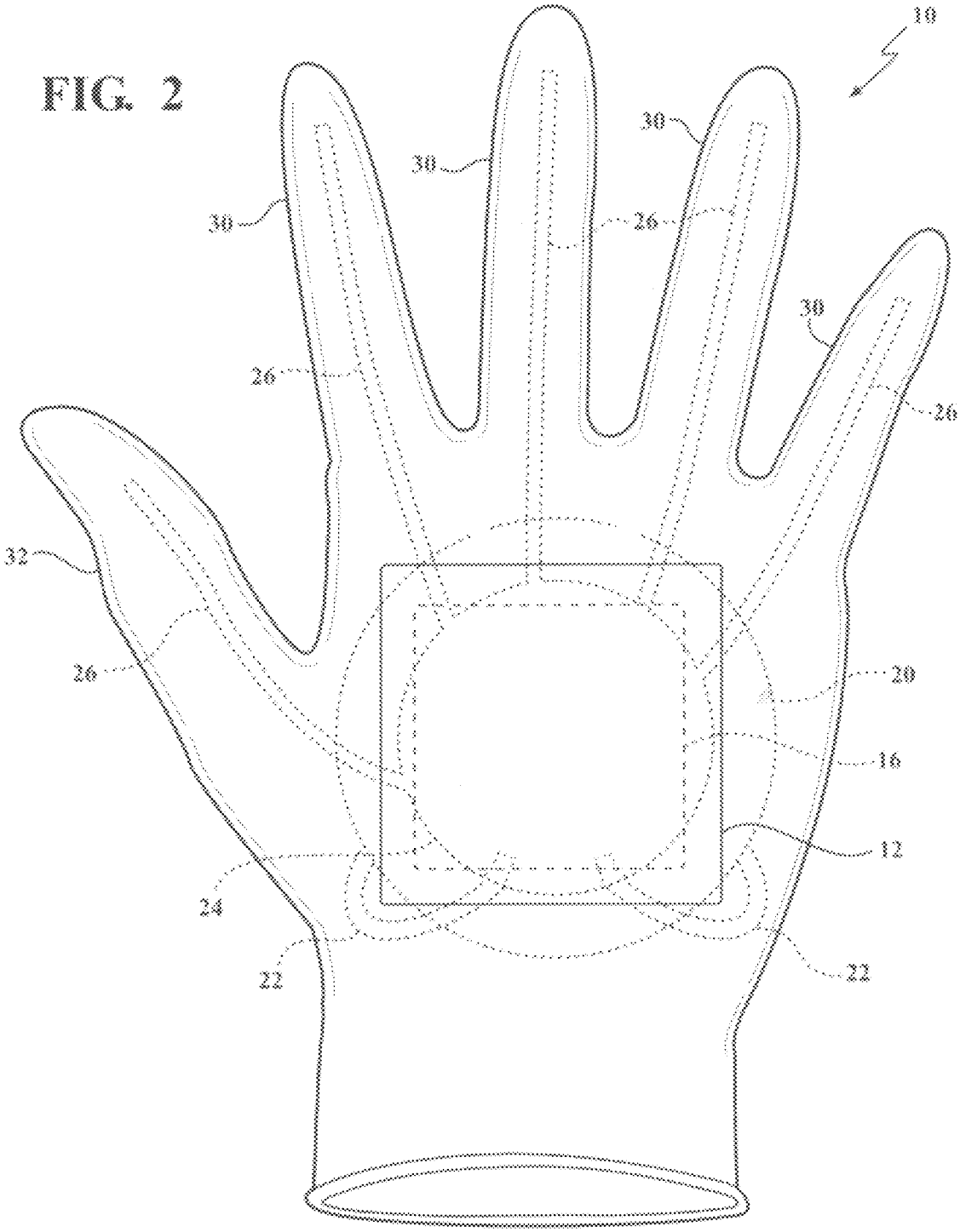
FIG. 2 is a back view of the glove shown in FIG. 1.

Referring to FIGS. 1 and 2, a glove 10 according to the invention is shown. A closable flap 12 is provided on the back of the glove extending over a pocket 14 receiving a conventional heat pack insert 16.

A mesh section 18 allows heat to warm the air in a heating bladder 20 lying beneath the heat pack insert 16. The bladder 20 has tubes 22 extending to a pumping bladder 24 located in the palm of the hand of a wearer which is resiliently collapsible when squeezed as by clenching the hand of the wearer.

The pumping bladder 24 has five outlet tubes 26 each extending into a respective finger and thumb portions 30, 32 of the glove 10.

A series of metering holes 28 may be provided in the tubes 26 to insure that the warm air reaches the ends of the fingers and thumb. Warm air is pushed into the tubes 26 when the pumping bladder 24 is squeezed down by the user and out into the fingers 30 and the thumb 32 portions of the glove 10 to warm the wearer's fingers and thumb inserted therein. A check valve 38 opens to only allow air flow out from the pumping bladder 24 when it is squeezed.

A second check valve 34 prevents air from being pushed out of the inlet 36 when the pumping bladder 24 is compressed.

When the pumping bladder 24 is released and resumes its expanded form, the second check valve 34 opens and allows warmed air to be drawn into the inlet 36 in preparation for the next squeeze cycle, while first check valve 38 prevents inflow from the outlet 39.

Warmed air is passed over the fingers and thumb of the wearer's hand and is drawn back into the heating bladder or chamber 20 via an air inlet 21 when the pumping bladder 24 is released, to be reheated therein.

Figure 3:
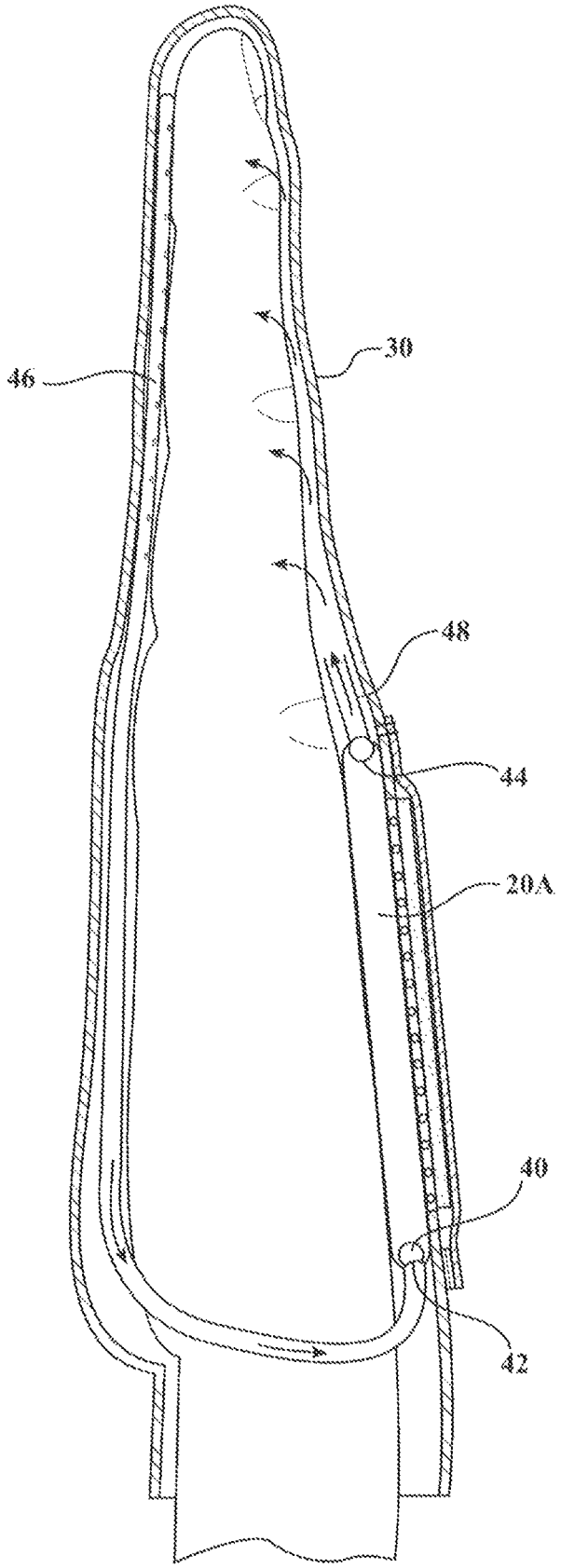
FIG. 3 is partially lengthwise sectional view of a modified form of the glove shown in FIG. 1 with the hand of a wearer shown inserted therein.

FIG. 3 shows another embodiment in which the separate pumping bladder 24 is not included. Rather, the heating bladder 20A on the back of the hand is used for pumping warmed air out an outlet 50 into the finger and thumb pockets. When the hand is clenched, this squeezes down the heating/pumping bladder 20A forcing warmed air out an outlet 48 into the finger thumb portions 30, 32. A first check valve 40 prevents flow outflow from inlet 42 when the heating bladder 20A is squeezed, while a second check valve 44 prevents reverse flow back into the outlet 48.

When the hand is restraightened, a check valve 40 opens to draw in return air from collector tubes 46 into the heating/pumping bladder 20A to be reheated, while a second check valve 44 prevents inflow from the outlet 48.

Figure 4:
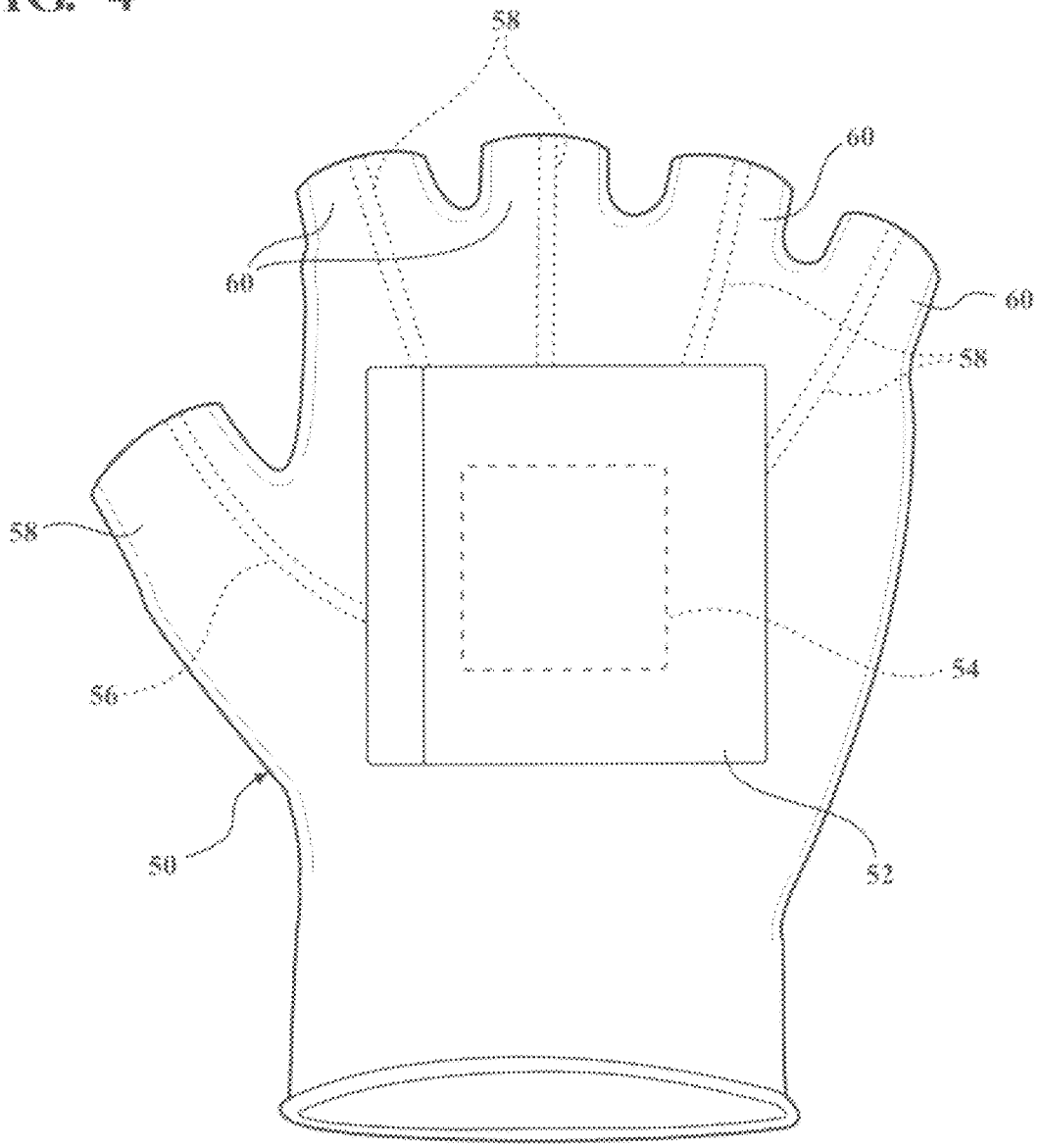
FIG. 4 is another modified form of the glove shown in FIG. 1 with the hand of a wearer shown inserted therein.
Figure 5:
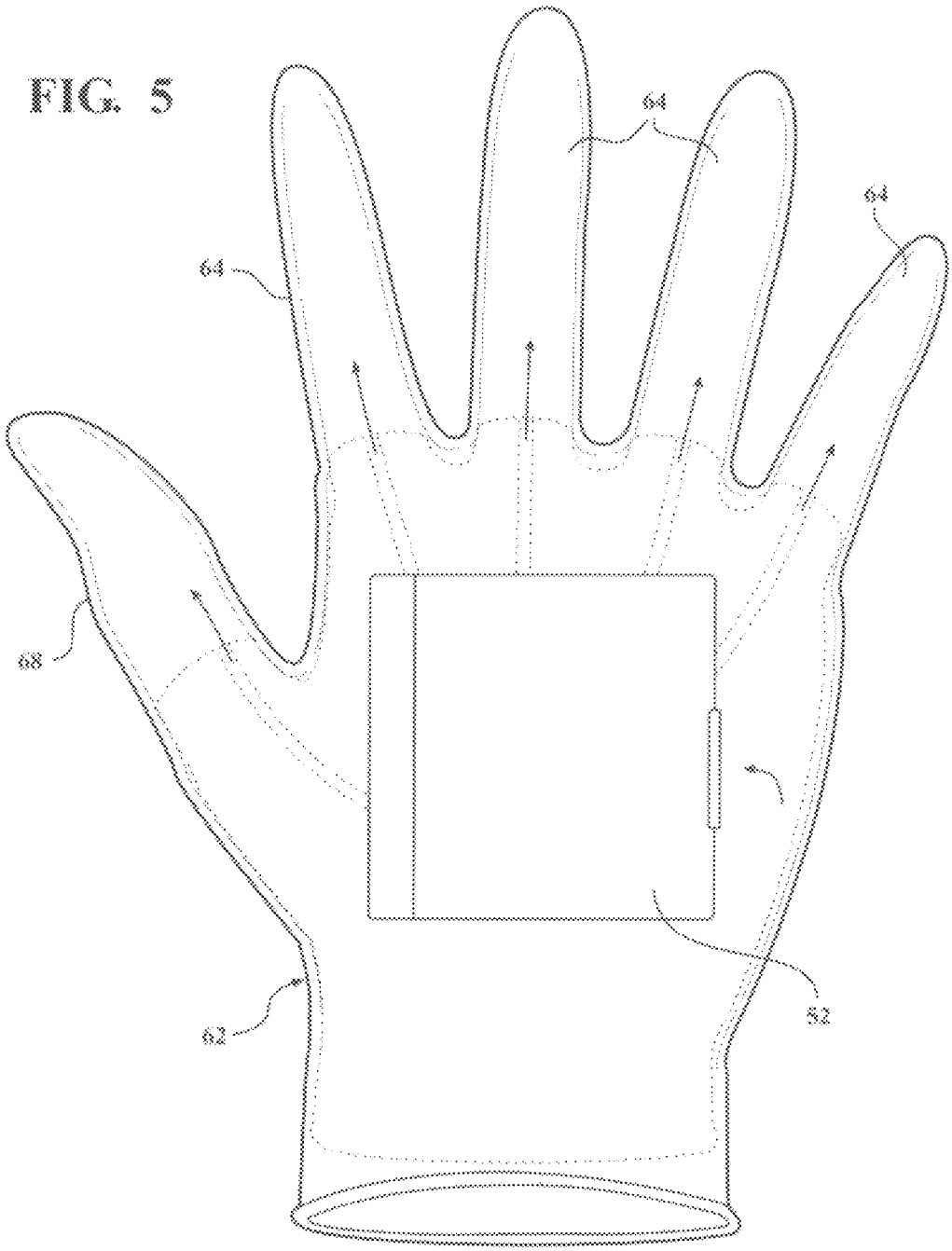
FIG. 5 is a back view of an insert for a glove according to another embodiment of the invention.

FIGS. 4 and 5 show another approach, in which a glove insert 50 is used having a bladder/pocket 52 holding a heat pack insert 54.

Tubes 56, 58 lead to cut off open ended finger/thumb portions 58, 60.

The insert 50 is first put on the user's hand and then into a conventional glove 62 is put on with the cut off finger/glove portions 58, 60 thereby put into the finger/glove portions 64, 66 of the glove 62 to warm the fingers and thumb of the wearer's hand.

This warmed air is not recirculated in this embodiment but simply moves into the glove and dissipates.

The invention claimed is:

1. A heated glove comprising:

an openable pocket located in a hand portion of the glove able to be opened and receive a heat pack which gives off heat after being activated; a heating chamber holding air adjacent said pocket to heat air therein when an activated heat pack is present;

a squeezably collapsible pumping bladder for drawing heated air out from said heating chamber and into an inlet of said pumping bladder connected thereto by one or more tubes when said pumping bladder is squeezed and released, and forcing said heated air out of an outlet of said pumping bladder when said pumping bladder is squeezed and into a series of tubes which are connected to said pumping bladder outlet and extend along finger and thumb pockets provided to receive a wearer's fingers and thumb;

a return flow path enabling warmed air circulated through said finger and thumb pockets to be drawn back into an inlet of said heating chamber when said squeezed pumping bladder is released and through said heating chamber to be reheated therein, said reheated air thereafter again drawn into said inlet of said pumping bladder when said pumping bladder is released after being squeezed;

a first check valve at said pumping bladder inlet preventing outflow from said pumping bladder inlet when said pumping bladder is squeezed but allowing inflow from said heating chamber when said squeezed pumping bladder is released; and a second check valve at said pumping bladder outlet allowing outflow from said pumping bladder when said pumping bladder is squeezed while not allowing inflow to said pumping bladder outlet.

2. The heated glove according to claim 1 wherein a series of metering holes are provided along said finger and thumb tubes so as to insure that heated air reaches the end of each of said tubes and the ends of said finger and thumb pockets as well as the intermediate portions thereof.

* * * * *